United States Patent [19]

Primati

[11] Patent Number: 4,642,921

[45] Date of Patent: Feb. 17, 1987

[54] HINGED SUPPORT FOR PORTABLE MECHANICAL IRONING MACHINE

[75] Inventor: Marco Primati, Cinisello Balsamo, Italy

[73] Assignee: Stabilimento Industriale Singer Srl, Milan, Italy

[21] Appl. No.: 706,882

[22] Filed: Mar. 1, 1985

[30] Foreign Application Priority Data

Mar. 5, 1984 [IT] Italy ..... 21108/84[U]

[51] Int. Cl.[4] ..... D06F 71/02

[52] U.S. Cl. ..... 38/36; 219/250

[58] Field of Search ..... 38/32, 34, 36; 219/250

[56] References Cited

U.S. PATENT DOCUMENTS 2,053,950 9/1936 Franklin ..... 38/34

FOREIGN PATENT DOCUMENTS 46-39518 11/1971 Japan ..... 38/36
501764 1/1971 Switzerland .
2045286 10/1980 United Kingdom ..... 38/36

*Primary Examiner*—Werner H. Schroeder
*Assistant Examiner*—Andrew M. Falik
*Attorney, Agent, or Firm*—Murray and Whisenhunt

[57] ABSTRACT

A portable mechanical ironing machine comprising a base supporting a fixed lower ironing plate, and a head hinged to the base and carrying a movable upper ironing plate. Compression spring devices are provided for applying ironing pressure to the movable upper ironing plate when it is in the closed position, and to pull the upper ironing plate towards the open position when the movable upper ironing plate is raised with respect to the fixed ironing plate. The spring devices are supported by a spring support which is movable between two stable positions, those positions being angularly offset with respect to each other. The ironing machine also comprises a handle pivoted to the head, and the handle is connected to the spring support for the compression spring devices by means of a kinematic connecting rod and crank mechanism. The connecting rod is pivoted to a fork which is pivoted at one end to the base and coupled at the other end to the spring support by means of a slot and pin coupling. The upper end of the spring support is associated with a first hook movable with the support and a second hook is fastened to the head pivoted at one of its ends and movable between a first locking position in which it engages the first locking hook and a second position in which it is inactive or neutral. The head is also fitted with devices accessible from the outside for operating the second hook between the two positions.

4 Claims, 5 Drawing Figures

HINGED SUPPORT FOR PORTABLE MECHANICAL IRONING MACHINE

BACKGROUND OF THE INVENTION

1. Field of the Invention

The present invention concerns a portable mechanical ironing machine for household use in particular.

2. Description of Related Art

Mechanical ironing machines consisting basically of a fixed lower ironing plate and a movable upper ironing plate designed to be lowered in such a way as to mate with a lower one and press against it and hence against the garments appropriately placed between them, simultaneously applying heat generated electrically by electrical resistances embedded therein are well known.

The use of springs designed to apply pressure to the ironing plate during the ironing step acting together with the manual effort applied to a handle or grip used for moving the upper ironing plate between the open or separating position with respect to the lower plate and the closed position with respect to the lower plate is also known.

In this respect and in relation to mechanical ironing machines in which the upper plate is hinged to a base bearing the fixed lower plate and in the hinge or joint section of which is housed a compression spring capable of assuming two stable positions, passing through a neutral point, in one of these positions the spring holds the upper plate in the open position while in the other position it applies the closing and ironing force.

Finally, various solutions have been proposed for shifting the spring, or rather its axis, and hence its support, from one of the positions to the other, using the operating handle or grip of the movable ironing plate.

According to a first solution, a translation of the handle or grip parallel to itself brings about the aforesaid shifting by means of a kinematic sector gear and rack mechanism. This mechanism is rather complicated and hence is costly to produce industrially, as well as costly to maintain and repair. It is well known that one of the basic requirements of an apparatus, especially of the household appliance type, is to reduce maintenance as much as possible and simplify it to the highest degree.

Another substantially equivalent solution is provided for in Swiss Pat. No. 501764 in which the operating or control handle of the movable ironing plate is connected to a kinematic mechanism which comprises a connecting rod which engages the support of the aforesaid spring. Rotation of the handle around its own axis of fastening to the upper ironing plate causes, through a crank mechanism, translation of the spring support between the aforesaid two positions.

This solution, while solving the problem itself, does not solve other problems which are also connected with the abovementioned accomplishments, problems which may be briefly summarized as follows:

1. The above handle or grip must complete a rather long stroke, pivoting through angles of 90 degrees and more. This means that the length or amount by which the handle may protrude beyond the upper ironing plate must be considerably reduced, consequently reducing the length of the lever arm and increasing the force which must be applied.

2. The abovesaid shifting of the spring support between the two positions mentioned involves the application of a force which is not constant but varies in the course of the shifting, with values which may be considerable, whereas one of the requirements of equipment of this kind is to require minimal and steady forces.

3. Since this is portable equipment, means must be provided to absolutely prevent opening of the ironing machine during transportation.

It is true that the abovementioned Swiss patent provides for a latch, but there is no assurance that this latch will not release as a result of incorrect handling of the equipment.

SUMMARY OF THE INVENTION

These and other problems are substantially solved with the portable mechanical ironing machine according to the present invention, which is of the type comprising a base supporting a fixed lower ironing plate and a head which is hinged to the base and carries a movable upper ironing plate. The machine is capable of assuming an open position corresponding to the rotation of the head with respect to the base and in which it is raised with respect to the fixed ironing plate, and a closed position in which it mates with the fixed lower plate. Compression spring devices are provided to apply ironing pressure to the movable upper plate when it is in the closed position, with the spring devices being supported by a support which is movable between two stable positions offset angularly one to the other. The support is positioned in one position, in such a way that the spring devices apply the ironing pressure and, in the other position, said support is positioned in such a way as to pull the upper ironing plate toward the open position. The said ironing machine also comprising a handle or grip pivoted to the head, the handle being connected to the support by means of a kinematic connecting rod and crank mechanism. The machine is characterized in that the connecting rod is pivoted to a plate which is pivoted at one end to the base and coupled at the other end to the spring support by means of a slot and pin coupling, and also characterized in that the upper end of the spring support is associated with a first movable hook locking to the support, while a second hook is fastened to the head pivoted at one of its ends and turnable from a first locking position in which it engages with the other end of the first locking hook and another position which is inactive or neutral. The head is also fitted with devices accessible from the outside for operating the second hook between the two positions and electrical switching devices operated by the second locking hook when it is in the position so as to deactivate electrical power supply to the equipment.

In conformance with the preferred embodiment, a stop is rigidly associated with the operating connecting rod which prevents operation toward said first position of said second locking hook.

BRIEF DESCRIPTION OF THE DRAWINGS

The advantages of the ironing machine according to the present invention will appear more clearly from the following detailed description and annexed drawings wherein.

DESCRIPTION OF PREFERRED EMBODIMENTS

Figure 1:
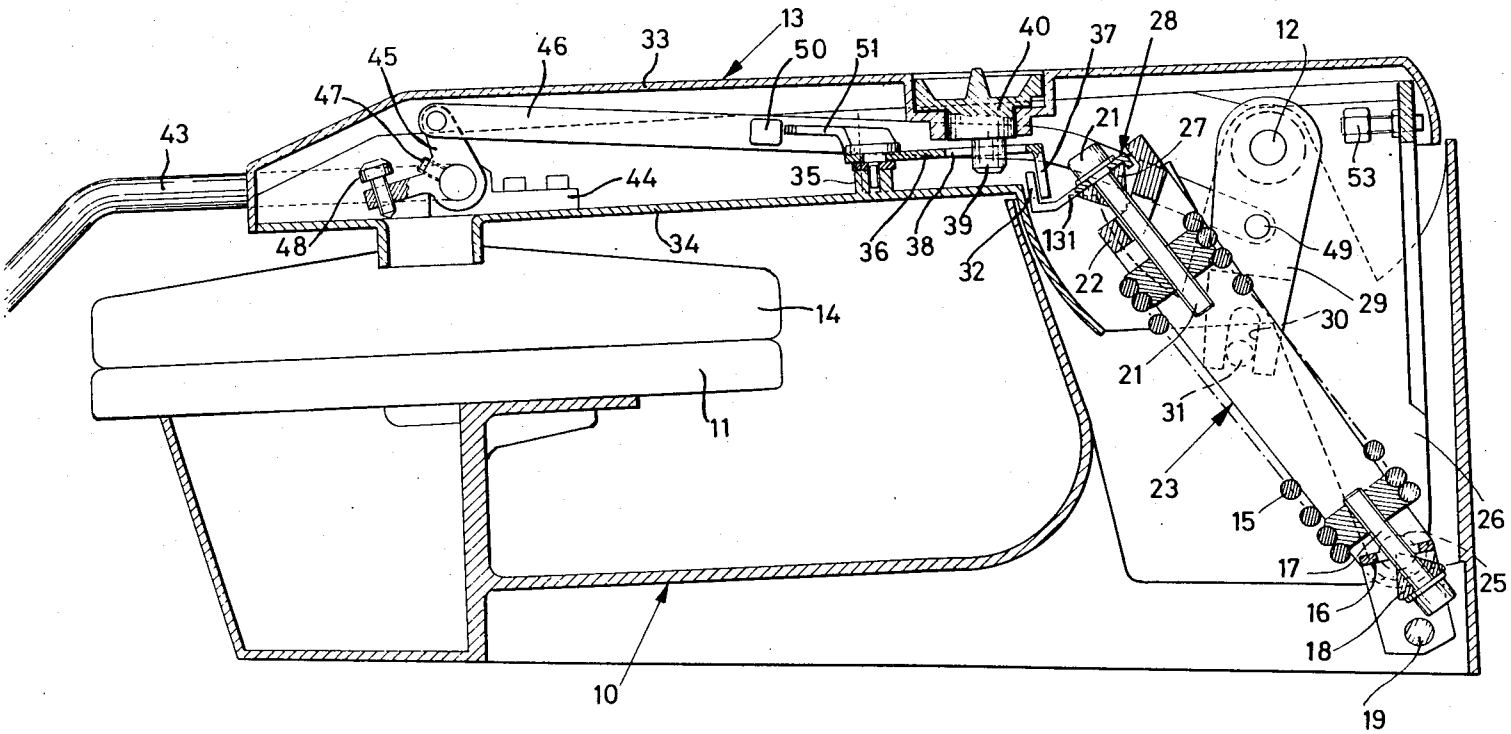
FIG. 1 is a substantially sectional side view of the mechanical ironing machine according to the invention in closed ironing position.

With reference to the drawings, the mechanical ironing machine according to the invention comprises a base 10 on which is rigidly mounted a fixed lower ironing plate 11. The latter is the conventional type and therefore will not be described in greater detail. To the base 10 is pivoted, at the axis identified by pins 12, a head 13 to which is fastened a movable upper ironing plate 14. The plate 14 is also the conventional type so that no further explanation is necessary.

For application of ironing pressure to the plate 14 through the head 13 is provided a compression spring 15 with its lower end fastened to a bracket 16 by means of a bolt 17 and a centering cone 18, the bracket 16 being shaped like the letter U and in turn pivoted, by means of a pin 19 to an anchor block 20, which is in turn fastened to the base 10.

At the top the spring 15 is fastened by means of a bolt 21 to the crosspiece 22 of a bracket 23 shaped like the letter U, the sides of which 24 are pivoted by means of pins 25 to the lower ends of supporting and pivoting bars 26. The upper ends of the pivoting bars are pivoted at the pins 12.

Figure 5:
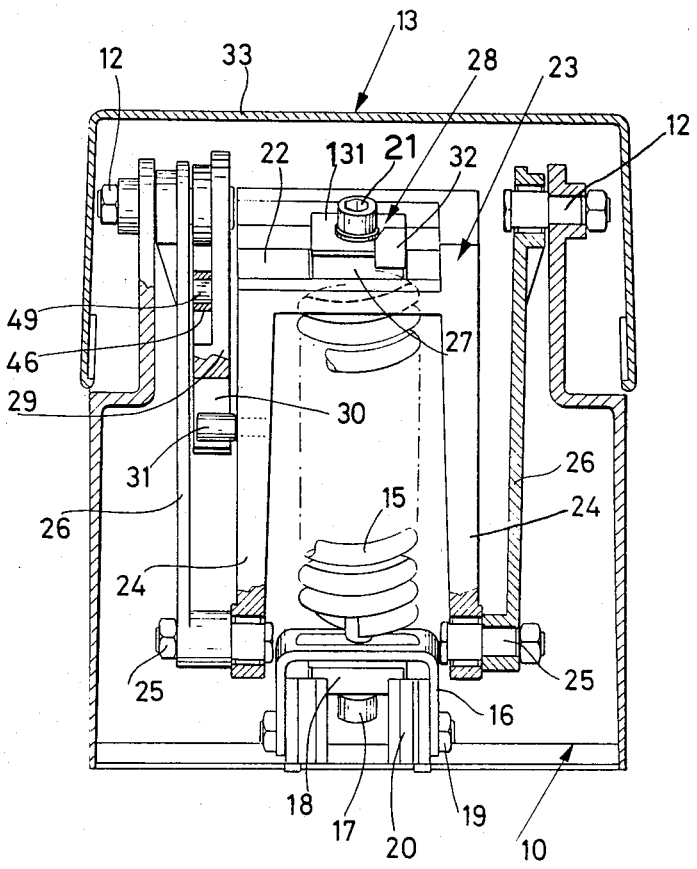
FIG. 5 is a sectional view on enlarged scale of the pivoted part between the base and the head.

As can be clearly seen in FIGS. 1 and 5, a fork 29 is pivoted at one of its ends to the base 10 at pin 12 and presents at the lower end an open slot 30, in which a sliding pin 31 is housed, rigidly integral with the side 24 of bracket 23.

Figure 2:
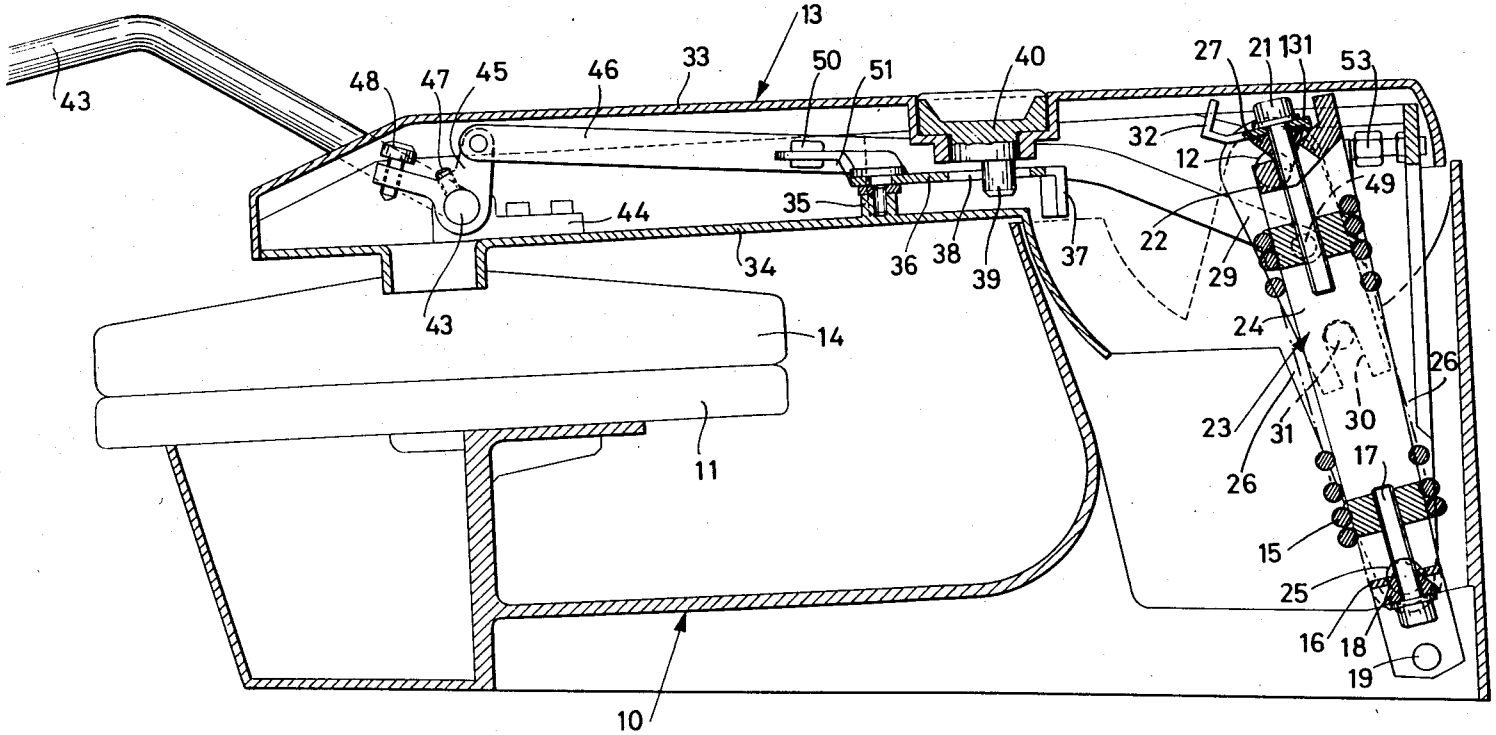
FIG. 2 is a view similar to that of FIG. 1 with the machine in the position of abutment without a workpiece to be ironed.
Figure 3:
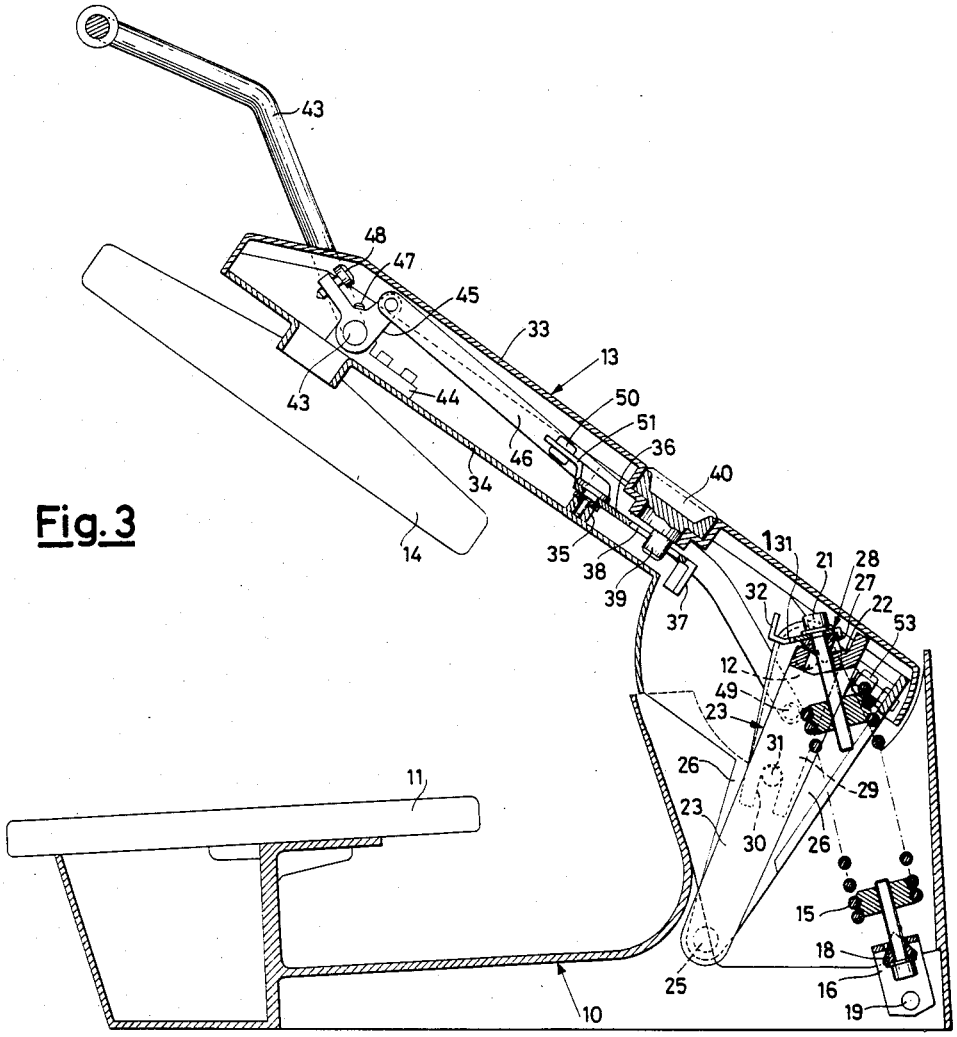
FIG. 3 shows the machine of FIG. 1 in the open position.

The structure which allows the head 13 to turn with respect to the base 10 and also allows the spring 15 to shift between the two operating positions indicated in FIGS. 1, 2 and 3 is clear from the preceding description.

At the upper end of the bracket 23 a tapered centering element 27 is provided, similar to element 18, above which is fastened a hooking and locking plate 28, which comprises a base 131 secured rigidly to the bracket 23 by the bolt 21 and a hooking and locking tooth 32 protruding upward from the base 131 for the purpose specified below.

The head 13 has a boxed construction comprising a cover 33 and a bottom 34. To the bottom 34 is fastened a vertical pin 35 to the upper end of which is fastened one end of a bracket 36. The opposite end of the bracket 36 is designed to interact with the hooking and locking tooth 32.

Figure 4:
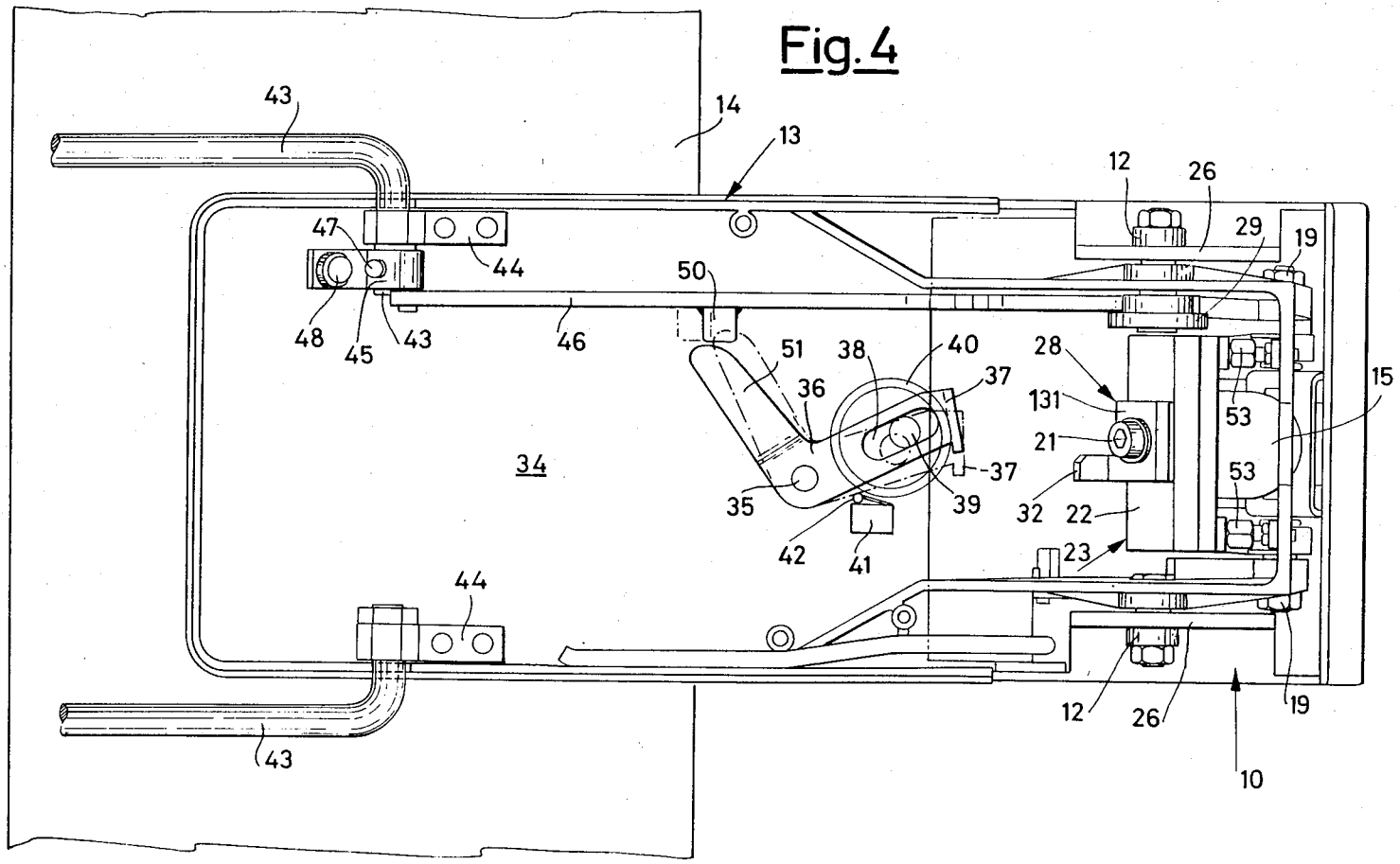
FIG. 4 is a plan view from above with the head cover omitted to show the details of the internal mechanisms.

The bracket 36 can turn between a locking position shown with dashed lines in FIG. 4 and a neutral position shown in the same figure with unbroken lines.

To secure movement of the bracket between the locking and neutral positions, bracket 36 has a slot 38 in which engages a vertical pin 39. The pin 39 is secured rigidly and excentrically to the lower face of a cylindrical knob 40 housed in a seat made in the cover 33 in such a way that it can turn but cannot be withdrawn from the seat.

The upper surface of the knob 40 is shaped with ribbing in such a way that it can be readily turned around its vertical axis.

As can be seen in FIG. 4, on the bottom 34 of the head 13 is mounted a microswitch 41, the sensitive element of which 42 is operated by the bracket 36 when it is turned to the locking position by means of the knob 40.

The microswitch 41 is connected to the electrical circuit of the ironing machine, in a known manner and for clarity not shown in the drawing, so that operation of the active element 42 causes the breaking of any electrical connection between the ironing machine and the outside electrical power supply.

To open and close the ironing machine, that is to move the upper ironing plate between the positions illustrated in FIGS. 1, 2 and 3, the machine is provided with a handle or grip 43, shaped like the letter U and having its ends pivoted to the head 13 on either side of head 13 by means of brackets 44. The grip 43 not only enables operation of the machine, but also allows the machine to be carried when not in use.

One end of the handle is rigidly integral through the locking pin 47 with a bell crank 45, with its fulcrum at the end which forms a pivot and has in turn one end pivoted to the end of a connecting rod 46. The other end of the crank 45 is fitted with an adjustable pin 48.

The connecting rod 46 is pivoted at the other end on the fork 29 by means of the pin 49.

From the connecting rod 46 protrudes a stop 50 which is engaged by an extension 51 on the bracket 36. The stop 50 has the function of preventing movement of the knob 40 toward the hooking position between the hooking teeth 32 and 37 and hence operation of the microswitch 41 except when the ironing machine is in the condition shown in FIG. 1, that is with the ironing plates closed and pressed by the spring 15.

By comparing the operating positions shown in FIGS. 1, 2 and 3 one of the basic characteristics of the present invention appears clearly, that is the fact that the travel of the handle 43 in passing from the open position of FIG. 3 to the closed position of FIG. 2 and finally to the ironing position shown in FIG. 1 is reduced to a few degrees corresponding to the rotation of the bell crank 45, whereas in the ironing machines heretofore known, the travel was greater than 90°, requiring therefore a considerable effort by the operator.

FIGS. 1 and 4 show two adjustable stops 53 which are used to set the stopping position of the bracket 23 when shifting between the two operating positions of the spring 15.

On this point it is important to observe that given the short travel of the handle 43 and consequently of the shifting mechanism (fork 29, slot 30 and pin 31) of the bracket 23, it is sufficient to exert a small force (a few hundred grams) to move the spring 15 to the position shown in FIG. 1 where it exerts the ironing pressure and move it back to the position shown in FIG. 3.

The invention has been described for a preferred embodiment, it being understood that conceptually equivalent modifications and variants are possible and foreseeable without going outside the limits of the invention.

I claim:

1. A portable mechanical ironing machine suitable for household use, comprising:

a base;

a fixed lower ironing plate connected to said base;

a head pivoted to said base;

a movable upper ironing plate connected to said head, said head being rotatable with respect to said base to move said movable ironing plate between a first open position in which it is raised with respect to said fixed ironing plate and a closed position in which said movable ironing plate contacts said fixed lower plate;

compression spring means for providing ironing pressure to said movable ironing plate when said movable ironing plate is in said closed position;

a spring support for supporting said compression spring means, said support being movable between two stable positions angularly offset one to the other, said support being positionable in a first position in such a way that said compression spring means apply ironing pressure and in a second position in such a way that said compression spring means urges said movable ironing plate towards said open position;

an operating handle hinged to said head, said handle being connected to said spring support through a kinematic connecting rod and crank mechanism;

a fork pivoted at one end to said base and coupled at the other end to said spring support through a slot and pin coupling, said connecting rod being pivoted to said fork;

a first locking hook connected to an upper end of said spring support, said first locking hook being movable with said spring support;

a second locking hook connected to said head and having two ends, said second locking hook being pivoted at one of its ends, and being movable between a first locking position in which the second end engages said first locking hook in a second neutral position;

means connected to said head and accessible from outside of said machine for moving said second locking hook between said first and second positions;

electrical switching devices operable by said second locking hook when in said first position so as to deactivate said machine by cutting off the supply of electrical power to the machine.

2. A portable machine according to claim 1, wherein a stop is rigidly mounted on said connecting rod for preventing movement of said second locking hook towards its first position.

3. A portable machine according to claim 2, wherein said second locking hook has an extension which interferes with translational movement of said connecting rod, and with said stop when said ironing machine is in said closed position.

4. A portable machine according to claim 1, wherein said means accessible from outside the machine include a substantially cylindrical knob turnable about its axis, and carrying an eccentrically mounted pin protruding downwardly, a slot in said second locking hook, said slot being engageable by said eccentrically mounted pin, rotation of said cylindrical knob causing rotation of said hook between said locking position and neutral position.

* * * * *